US006506966B2

(12) United States Patent
Miura

(10) Patent No.: US 6,506,966 B2
(45) Date of Patent: Jan. 14, 2003

(54) ERRONEOUS OPENING PREVENTION MECHANISM FOR A GRAND PIANO LID

(75) Inventor: Hirohiko Miura, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/961,852

(22) Filed: Sep. 24, 2001

(65) Prior Publication Data

US 2002/0035911 A1 Mar. 28, 2002

(30) Foreign Application Priority Data

Sep. 27, 2000 (JP) ..... 2000-294414

(51) Int. Cl.[7] ..... G10C 3/02

(52) U.S. Cl. ..... 84/177; 84/178; 84/180; 84/186.1; 84/202

(58) Field of Search ..... 84/177, 178, 184, 84/186.1, 202, 180, 176

(56) References Cited

U.S. PATENT DOCUMENTS 6,172,293 B1 * 1/2001 Anderson ..... 84/453

* cited by examiner

*Primary Examiner*—Shih-Yung Hsieh
(74) *Attorney, Agent, or Firm*—Davis & Bujold, P.L.L.C.

(57) ABSTRACT

In an erroneous opening prevention mechanism according to the present invention, a hook and a hook support are loosely engaged with one another when a front lid, folded back on a back lid, is unfolded, or laid flat. If an attempt to raise the whole lid laid flat on a grand piano main body is made, it is impossible to raise the lid due to the locking of the hook and the hook support. When the front lid is folded back onto the back lid, on the contrary, the hook and the hook support are released from one another and, therefore, the whole lid can be raised. Accordingly, the erroneous opening prevention mechanism prevents the whole lid from being raised without first folding back the front lid.

20 Claims, 6 Drawing Sheets

ERRONEOUS OPENING PREVENTION MECHANISM FOR A GRAND PIANO LID

BACKGROUND OF THE INVENTION (i) Field of the Invention

The present invention relates to an erroneous opening prevention mechanism for a grand piano lid.

(ii) Description of the Related Art

As shown in FIG. 5, while performing on a grand piano 100, the lid 110 of the grand piano 100 is usually raised via a side root hinge 146 and supported with a long or short lid prop 120 such that the lid remains open at a desired angle. Alternatively, when a lowered volume is required while performing on the grand piano 100, the lid 110 is closed, or laid flat on a grand piano main body 140, as shown in FIG. 6.

The grand piano 100 is provided with a music desk 130 under the lid 110 on the keyboard 150 side. Therefore, in order to allow use of the music desk 130 even with the lid 110 closed, as shown in FIG. 6, the lid 110 comprises a front lid 112 covering the music desk 130 and a back lid 114 connected with each other by a not shown hinge, whereby the front lid 112 can be folded back onto or over the back lid 114.

At the time of performing on the grand piano 100 with the lid 110 raised, as shown in FIG. 51 the front lid 112 is to be folded back onto or over the back lid 114 before raising the lid 110. This is because raising the lid 110 without first folding back the front lid 112 causes the heavy front lid 112 to be supported by only the hinge (not shown) attached to the back lid 114, since the lid prop 120 merely supports the back lid 114.

However, in the case where a person who is inexperienced in handling the grand piano 100 sets the grand piano 100 in a, concert hall, for example, the lid 110 is sometimes raised without first folding back the front lid 112.

Therefore, piano makers usually adopt safety measures, such as providing a large number of hinges, in preparation for a case like the above. Such measures, however, result in an additional cost as well as unsightly appearance for the grand piano 100.

SUMMARY OF THE INVENTION

Wherefore, an object of the present invention is to provide an erroneous opening prevention mechanism for preventing a grand piano lid from being raised without first folding back a front lid.

To attain this and other objects, the present invention discloses a grand piano comprising a combined lid fixed to a piano main body such that the lid is raised at a desired angle relative to the piano main body or laid flat on the piano main body, the combined lid including a back lid and a front lid foldable onto or over the back lid, the grand piano being provided with erroneous opening prevention means for preventing the lid from being raised without first folding back the front lid onto or over the back lid.

Also, an erroneous opening prevention mechanism, according to the present invention, comprises first locking means fixed to the front lid and second locking means fixed to the piano main body, and may be adapted such that when the front lid is unfolded and the lid is laid flat to cover the piano main body, the first locking means and the second locking means lock with one another to prevent the lid from being raised from the piano main body, and when the front lid is folded back onto the back lid, the first locking means and the second locking means are released from one another to allow the lid to be raised from the piano main body.

If an attempt to raise the lid is made without first folding back the front lid, the first locking means is caught in or engaged with the second locking means and, therefore, the lid cannot be raised. If the front lid is first folded back, however, the first locking means and the second locking means are released from one another and, therefore, the lid can be raised.

In this case, it is preferable that the first locking means is disposed in the vicinity of the fold line along which the front lid is folded back onto or over the back lid. When the first locking means is disposed as above, the moment against the fold line area (the moment generated by the front lid spontaneously falling in the opposite direction to the direction in which the front lid is folded back onto or over the back lid) is small. Accordingly, only a relatively small load is imposed on the fold line area, and related problems, such as loosening, are prevented from being caused. Specifically, in the case where a hinge is used in the fold line area, it is possible to prevent the hinge from becoming loose.

BRIEF DESCRIPTION OF THE DRAWINGS

A preferred embodiment of the present invention will now be described, with reference to the drawings, in which.

DETAILED DESCRIPTION OF A PREFERRED EMBODIMENT

Figure 1A:
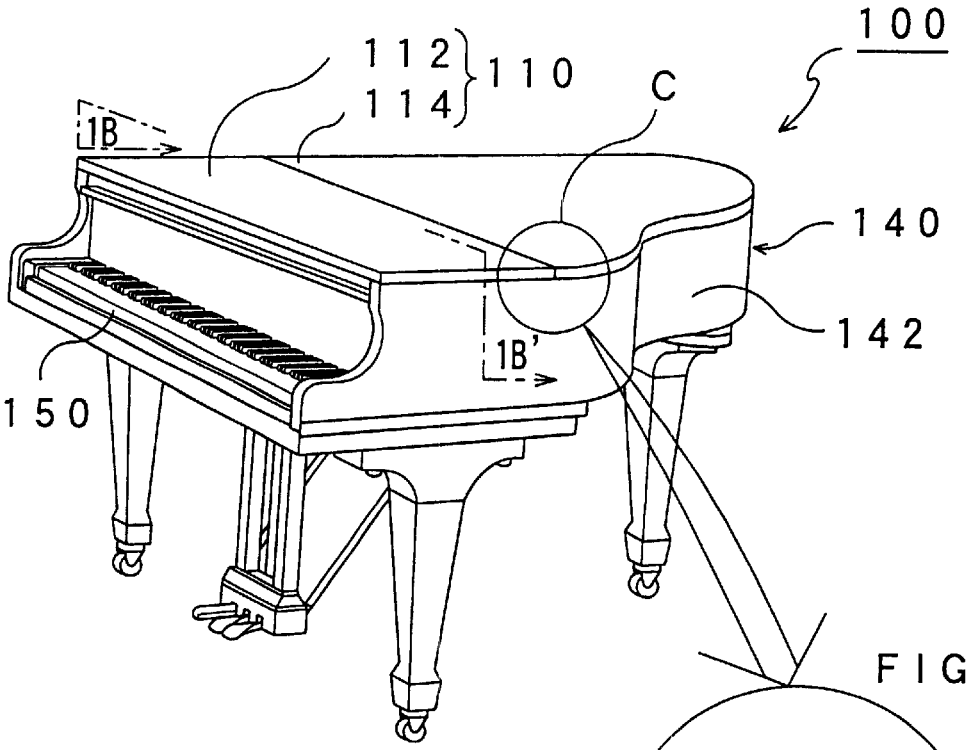
FIG. 1A is a diagrammatic perspective view showing a grand piano with its front lid unfolded and its combined lid laid flat.

As shown in FIG. 1A, a grand piano 100, in which an erroneous opening prevention mechanism 1 according to a preferred embodiment of the invention is disposed, is provided with a combined lid 110 comprising a front lid 112 and a back lid 114.

Figure 3A:
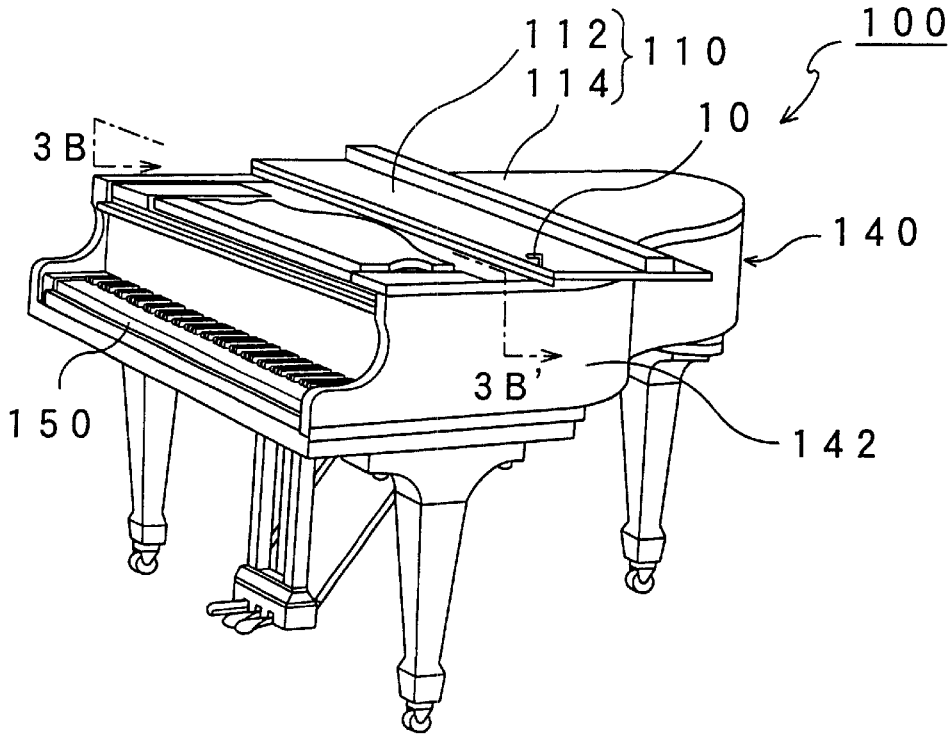
FIG. 3A is a diagrammatic perspective view showing a grand piano with its front lid folded back and its combined lid raised.
Figure 3B:
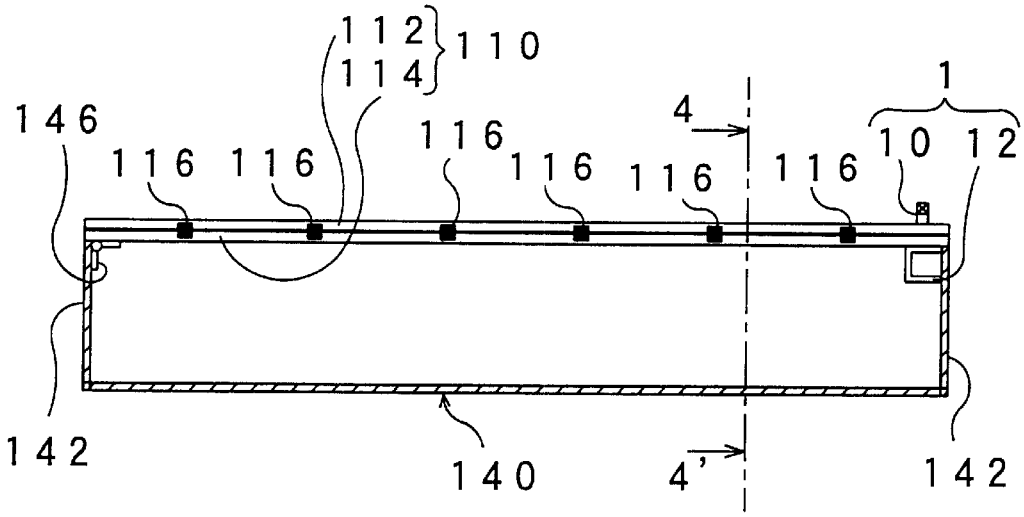
FIG. 3B is a sectional view taken along line 3B–3B' of FIG. 3A.
Figure 4:
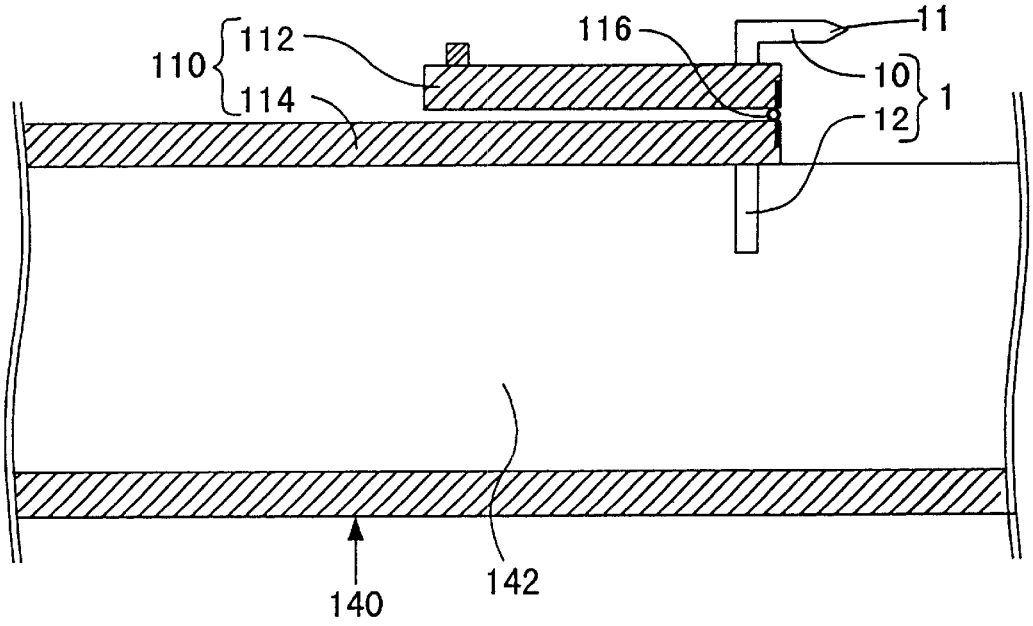
FIG. 4 is a sectional view taken along line 4–4' of FIG. 3B.
Figure 5:
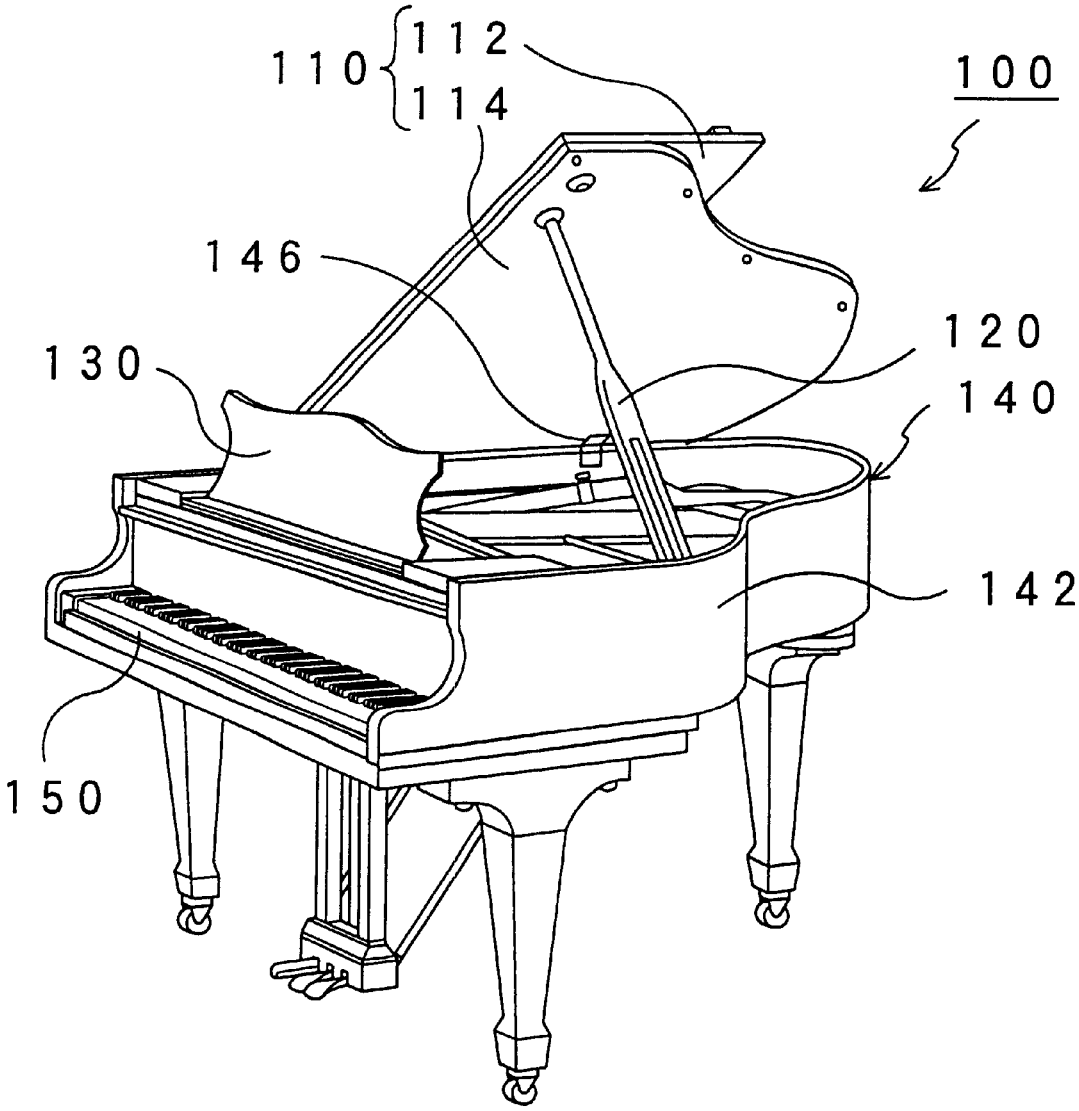
FIG. 5 PRIOR ART
FIG. 5 is a diagrammatic perspective view showing a conventional grand piano with its front lid folded back and its combined lid raised.
Figure 6:
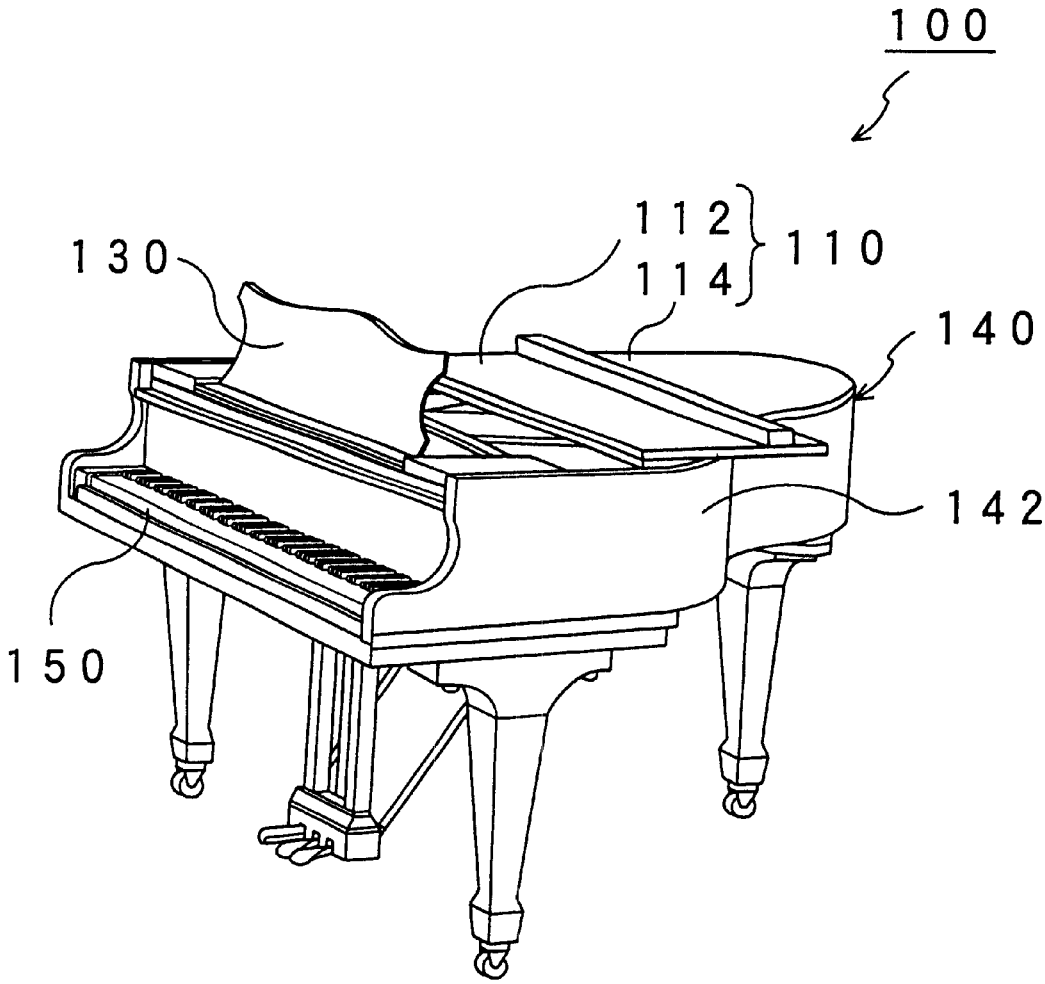
FIG. 6 PRIOR ART
FIG. 6 is a diagrammatic perspective view showing a conventional grand piano with its front lid folded back and its combined lid laid flat.

The lid 110 is such that the front lid 112 can be folded back onto or over the back lid 114, as shown in FIG. 3A. The front lid 112 and the back lid 114 are connected with each other by at least one or a plurality of lid hinges 116, as shown in FIG. 3B. In addition, the lid 110 is also fixed to a grand piano main body 140 by at least one side hinge 146 along one side of the lid 110 in the direction of the alignment of keys constituting a keyboard 150 of the grand piano 100, and can be raised by lifting up the opposite side thereof, or the right side of FIG. 1B.

Figure 1C:
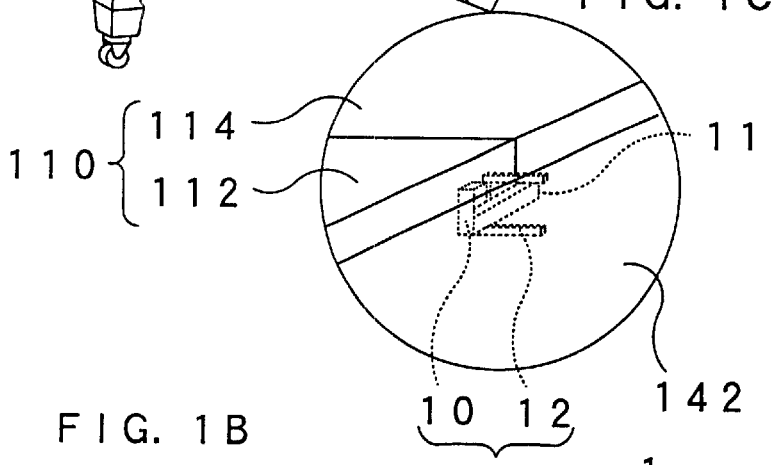
FIG. 1C is a diagrammatic enlarged view of area C of FIG. 1A.
Figure 1B:
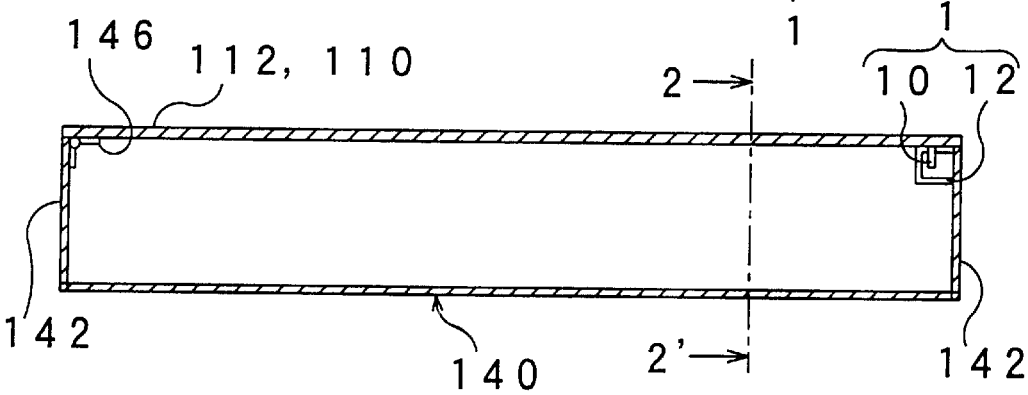
FIG. 1B is a sectional view taken along line 1B–1B' of FIG. 1A.
Figure 2:
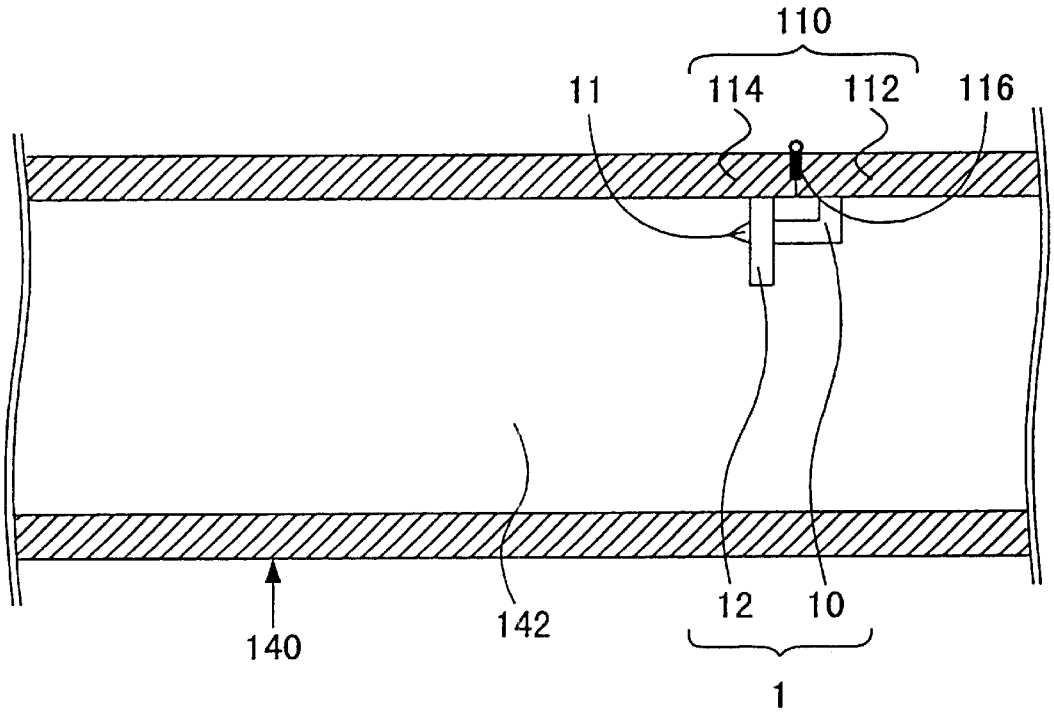
FIG. 2 is a sectional view taken along hue 2–2' of FIG. 1B.

The erroneous opening prevention mechanism 1, according to the invention, comprises a hook 10 and a hook support 12, and is provided inside the grand piano 100, as shown in a partly enlarged view of area C of FIGS. 1A and 1C.

The hook 10, having substantially an L-shaped configuration, is fixed to an under or downwardly facing surface of the front lid 112. Specifically, the hook 10 is disposed in the vicinity of the hinge 116 on a fold line along which the front lid 112 is folded back onto or over the back lid 114, and, at the same time, on the right side of FIG. 1B where the lid 110 is raised via the hinge 146 about a pivotal connection or pivot axis. The hook 10 is fixed to the front lid 112 such that a tip end 11 thereof reaches a space under the back lid 114 when the front lid 112 is unfolded, as shown in FIG. 1A. The hook 10 corresponds to first locking means according to the invention.

The hook support 12, having substantially a U-shaped configuration, is fixed to an inner surface of a side panel 142 constituting the grand piano main body 140 on the standing side. Specifically, the hook support 12 is disposed in the vicinity of the hinge 116 on the fold line, and, at the same time, under the back lid 114. The hook support 12 is fixed to the side panel 142 such that a tip end 11 of the hook 10 is loosely engaged with the hook support 12 when the front lid 112 is unfolded, as shown in FIG. 1A. The hook support 12 corresponds to second locking means according to the invention.

In the grand piano 100 with the above described erroneous opening prevention mechanism 1 provided therein, if an attempt to raise the lid 110 laid flat on the grand piano main body 140 is made with the front lid 112 unfolded, as shown in FIG. 1A (i.e. the front lid 112 and the back lid 114 are coplanar with one another), the hook 10 and the hook support 12 are locked into or with one another. Accordingly, it is impossible to raise the lid 110 with the hinge 146 as an axis. On the contrary, when the front lid 112 is folded back on the back lid 114, as shown in FIG. 3A, the hook 10 and the hook support 12 are released from one another, and, therefore, the lid 110 can be raised by the hinge 146 about the pivotal connection or pivot axis, Thus, use of the erroneous opening prevention mechanism 1, according to the embodiment, prevents the lid 110 from being raised without first folding back the front lid 112.

Further, even if the back lid 114 is erroneously lifted up without first folding back the front lid 112, the moment against the hinge 116 (the moment generated by the front lid 112 spontaneously falling in the opposite direction to the direction in which the front lid 112 is folded back on the back lid 114) is small because the hook 10 is disposed in the vicinity of the hinge 116. Accordingly, only a relatively small load is imposed on the hinge 116 and the hinge 116 is prevented from becoming loose.

Although the present invention has been described with reference to the preferred embodiment, it is to be appreciated that the present invention should not be limited to the embodiment and various modifications may be made.

What is claimed is:

1. A grand piano, comprising:

a piano main body;

a combined lid pivotally connected to the piano main body, the combined lid having a closed position in which the combined lid covers the piano main body and a raised position in which the combined lid is pivoted to a desired angle with respect to the piano main body, and the combined lid comprising a front lid pivotally connected to a back lid by at least one hinge; and an erroneous opening prevention mechanism for preventing the combined lid from being pivoted to the raised position without first folding the front lid back onto the back lid.

2. The grand piano according to claim 1, wherein the erroneous opening prevention mechanism comprises a first locking device secured to the front lid and a mating second locking device secured to an interior side of the piano main body, and the first and second locking devices facilitate free folding of the front lid back onto the back lid but prevent the combined lid from being pivoted to the raised position until the front lid is first folded over onto the back lid.

3. The grand piano according to claim 2, wherein the first locking device is a hook secured to the front lid and the mating second locking device is a hook support secured to the interior side of the piano main body.

4. The grand piano according to claim 3, wherein the hook has a substantially L-shaped configuration and the hook support has a substantially U-shaped configuration.

5. The grand piano according to claim 2, wherein the first locking device is secured to an under surface of the front lid and the second locking device is secured to the piano main body adjacent the pivotal connection of the front lid to the back lid.

6. The grand piano according to claim 1, wherein the grand piano has a keyboard with a plurality of keys, and the pivotal connection of the combined lid to the piano main body comprises at least one hinge extending parallel to a longitudinal direction defined by each one of the plurality of keys of the keyboard.

7. The grand piano according to claim 1, wherein the grand piano has a keyboard with a plurality of keys, and the pivotal connection of the front lid to the back lid comprises at least one hinge extending perpendicular to an axial direction defined by each one of the plurality of keys of the keyboard.

8. The grand piano according to claim 1, wherein the grand piano has a keyboard with a plurality of keys, a music desk for supporting music and a lid prop for maintaining the combined lid in a desired raised position.

9. An erroneous opening prevention mechanism provided in a grand piano having a piano main body with a combined lid pivotally connected to the piano main body, and the combined lid comprising a front lid pivotally connected to a back lid by at least one hinge, the erroneous opening prevention mechanism comprising:

a first locking means secured to the front lid;

a mating second locking means secured to the piano main body; and the erroneous opening prevention mechanism facilitating release of the first locking means from the second locking means, when the front lid is folded back onto the back lid, to allow the combined lid to be pivoted to a desired raised position relative to the piano main body, and the first locking means engaging with the second locking means, when the front lid is in an unfolded orientation in which the front lid is coplanar with the back lid, so as to prevent pivoting of the combined lid to a desired raised position relative to the piano main body.

10. The erroneous opening prevention mechanism according to claim 9, wherein the combined lid has a closed position in which the front lid and the back lid are coplanar with one another and the combined lid covers the piano main body and at least one raised position in which the combined lid is raised to a desired angle with respect to the piano main body.

11. The erroneous opening prevention mechanism according to claim 9, wherein the first locking means facilitate free folding of the front lid onto the back lid but prevent the combined lid from pivoting to the raised position unless the front lid is first folded back onto the back lid.

12. The erroneous opening prevention mechanism according to claim 9, wherein the first locking means is a hook secured to the front lid and the mating second locking means is a hook support secured to an interior side of the piano main body.

13. The erroneous opening prevention mechanism according to claim 12, wherein the hook has a substantially L-shaped configuration and the hook support has a substantially U-shaped configuration.

14. The erroneous opening prevention mechanism according to claim 9, wherein the first locking means is secured to an under surface of the front lid and the second locking means is secured to the piano main body adjacent the pivotal connection of the front lid to the back lid.

15. The erroneous opening prevention mechanism according to claim 9, wherein the grand piano has a keyboard with a plurality of keys, and the pivotal connection of the combined lid to the piano main body comprises at least one hinge extending parallel to a longitudinal direction defined by each one of the plurality of keys of the keyboard.

16. The erroneous opening prevention mechanism according to claim 9, wherein the grand piano has a keyboard with a plurality of keys, a music desk for supporting music and a lid prop for maintaining the combined lid in a desired raised position.

17. An erroneous opening prevention mechanism provided in a grand piano having a piano main body with a combined lid pivotally connected to the piano main body, and the combined lid comprising a front lid pivotally connected to a back lid by at least one hinge, the erroneous opening prevention mechanism comprising:

a first locking device secured to the front lid;

a mating second locking device secured to the piano main body; and the erroneous opening prevention mechanism facilitating release of the first locking device from the second locking device, when the front lid is folded back onto the back lid, to allow the combined lid to be pivoted to a desired raised position relative to the piano main body, and the first locking device engaging with the second locking device, when the front lid is in an unfolded orientation in which the front lid is coplanar with the back lid, so as to prevent pivoting of the combined lid to a desired raised position relative to the piano main body.

18. The erroneous opening prevention mechanism according to claim 17, wherein the combined lid has a closed position in which the front lid and the back lid are coplanar with one another and the combined lid covers the piano main body and at least one raised position in which the combined lid is raised to a desired angle with respect to the piano main body and the first and second locking devices facilitate free folding of the front lid onto the back lid but prevent the combined lid from pivoting to the raised position unless the front lid is first folded back onto the back lid.

19. The erroneous opening prevention mechanism according to claim 17, wherein the first locking device is a hook secured to the front lid and the mating second locking device is a hook support secured to the interior side of the piano main body; and the hook has a substantially L-shaped configuration and the hook support has a substantially U-shaped configuration.

20. The erroneous opening prevention mechanism according to claim 17, wherein the first locking device is secured to an under surface of the front lid and the second locking device is secured to the piano main body adjacent the pivotal connection of the front lid to the back lid.

* * * * *